US009346153B2

(12) United States Patent
Huang

(10) Patent No.: US 9,346,153 B2
(45) Date of Patent: May 24, 2016

(54) ADJUSTABLE WRENCH WITH REINFORCING DEVICE

(71) Applicant: New Way Tools Co., Ltd., Taichung (TW)

(72) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 267 days.

(21) Appl. No.: 14/132,056

(22) Filed: Dec. 18, 2013

(65) Prior Publication Data

US 2015/0135911 A1 May 21, 2015

(30) Foreign Application Priority Data

Nov. 19, 2013 (TW) ..... 102142043 A

(51) Int. Cl.
*B25B 13/14* (2006.01)
*B25B 13/12* (2006.01)

(52) U.S. Cl.
CPC ..... *B25B 13/14* (2013.01); *B25B 13/12* (2013.01)

(58) Field of Classification Search
CPC ..... B25B 13/12; B25B 13/14
See application file for complete search history.

(56) References Cited

U.S. PATENT DOCUMENTS

| | | | | |
|---|---|---|---|---|
| 864,710 | A * | 8/1907 | Vaughn | B25B 13/14 81/165 |
| 1,407,528 | A * | 2/1922 | Gordon | B25B 13/14 81/135 |
| 2,719,448 | A * | 10/1955 | Bugge | B25B 13/12 81/145 |
| 4,753,141 | A | 6/1988 | Hamrick et al. | |
| 5,746,099 | A | 5/1998 | Janson | |
| 6,679,139 | B2 | 1/2004 | Brenizer | |
| 6,848,342 | B2 | 2/2005 | Bergfeld, III | |
| 6,962,099 | B2 | 11/2005 | Slepekis | |
| 7,117,768 | B1 | 10/2006 | Stoeppelwerth | |
| 7,275,464 | B2 * | 10/2007 | Chervenak | B25B 13/12 81/165 |
| 8,136,429 | B2 | 3/2012 | Wu | |
| 2001/0052274 | A1 | 12/2001 | Wang | |
| 2004/0035262 | A1 * | 2/2004 | Hsien | B25B 13/14 81/170 |
| 2005/0178248 | A1 | 8/2005 | Hsien | |
| 2009/0120246 | A1 * | 5/2009 | Wu | B25B 13/22 81/129 |
| 2011/0120277 | A1 | 5/2011 | Wu | |
| 2012/0312129 | A1 | 12/2012 | Huang | |
| 2013/0247725 | A1 | 9/2013 | Huang | |

FOREIGN PATENT DOCUMENTS

| | | | |
|---|---|---|---|
| JP | H0596209 | U | 12/1993 |
| JP | 2006312864 | A | 11/2006 |
| TW | 47719 | U | 11/1982 |

(Continued)

*Primary Examiner* — David B Thomas
(74) *Attorney, Agent, or Firm* — Alan D. Kamrath; Kamrath IP Lawfirm, P.A.

(57) ABSTRACT

An adjustable wrench includes a handle, a head, a slidable jaw, an adjusting assembly, and a reinforcing device. The head formed at one end of the handle and includes a fixed jaw, a sliding rail, a receiving slot, two lateral walls, and two connecting portions. The sliding rail is formed between the two lateral walls. The receiving slot communicates with the sliding rail. Each connecting portion is formed at one end of each lateral wall opposite to the fixed jaw. The slidable jaw is slidably disposed in the sliding rail. The adjusting assembly is positioned in the receiving slot and engaged with the slidable jaw. The reinforcing device connects the two lateral walls and is engaged into the two connecting portions.

10 Claims, 8 Drawing Sheets

(56) References Cited

FOREIGN PATENT DOCUMENTS

| | | | |
|---|---|---|---|
| TW | 421105 | U | 2/2001 |
| TW | 445926 | U | 7/2001 |
| TW | 524170 | U | 3/2003 |
| TW | 554784 | U | 9/2003 |
| TW | I268833 | B | 12/2006 |
| TW | I274633 | B | 3/2007 |
| TW | I286098 | B | 9/2007 |
| TW | M369221 | U | 11/2009 |
| TW | M371610 | U | 1/2010 |
| TW | M392038 | U | 11/2010 |
| TW | I340064 | | 4/2011 |
| TW | 1346599 | | 8/2011 |
| TW | M415784 | U | 11/2011 |
| TW | I354604 | B | 12/2011 |
| TW | M427236 | U | 4/2012 |
| TW | I374072 | B | 10/2012 |
| TW | I414398 | B | 11/2013 |
| TW | M464275 | U | 11/2013 |
| TW | M474598 | U | 3/2014 |
| WO | WO9218288 | A1 | 10/1992 |
| WO | WO9401247 | A2 | 1/1994 |

* cited by examiner

ADJUSTABLE WRENCH WITH REINFORCING DEVICE

BACKGROUND OF THE INVENTION

1. Field of the Invention

The present invention relates to a wrench and, in particular, to an adjustable wrench that includes a reinforcing device for increasing its structural strength to prevent deformation of two walls of a rail of the adjustable wrench caused by improper operation or when impinged by an outside force.

2. Description of the Related Art

A conventional wrench is a tool used to provide grip and mechanical advantage in applying torque to turn objects, usually rotary fasteners, such as nuts and bolts, or to keep them from turning. One type of the wrench is called an open end wrench, which has a U-shaped opening to grip two opposite faces of the bolt or nut. This wrench is often double ended, with a different-sized opening at each end. The ends are generally oriented at an angle of around 15 degrees to the longitudinal axis of the handle. This allows a greater range of movement in enclosed spaces by flipping the wrench over. Moreover, an adjustable wrench is a wrench with a jaw of adjustable width, allowing it to be used with different sizes of fastener heads rather than just one fastener, as with a conventional open end wrench.

U.S. Pat. No. 8,136,429 discloses an adjustable wrench, which includes a handle, a head, a slidable jaw, an axial rod and a worm gear. The head is formed with a fixed jaw, a sliding rail, and a receiving slot. The slidable jaw has a sliding rod slidably disposed in the sliding rail of the head. The axial rod and the worm gear are disposed in the receiving slot of the head, and the worm gear engages with the sliding rod of the slidable jaw to control the movement of the slidable jaw in relation to the fixed jaw, so that an opening formed between the fixed and slidable jaws can be adjustable for different sizes of fastener heads. However, when the adjustable wrench turns objects, the sliding rod will push against the sliding rail to cause deformation of two walls of the sliding rail.

The present invention is, therefore, intended to obviate or at least alleviate the problems encountered in the prior art.

SUMMARY OF THE INVENTION

In view of the foregoing disadvantages inherent in the known types of adjustable wrenches now present in the prior art, the present invention provides an adjustable wrench including a handle, a head, a slidable jaw, an adjusting assembly, and a reinforcing device. The head is formed at one end of the handle and includes a fixed jaw, a sliding rail, a receiving slot, two lateral walls, and two connecting portions. The fixed jaw is formed at one end of the two lateral walls. The sliding rail is formed between the two lateral walls. The receiving slot is connected and in communication with the sliding rail. Each connecting portion is formed at one end of each lateral wall opposite to the fixed jaw. The slidable jaw is slidably disposed in the sliding rail of the head. The adjusting assembly is positioned in the receiving slot of the head and includes an axial rod and a worm gear. The axial rod inserts through the worm gear, and the worm gear is engaged with the slidable jaw. The reinforcing device connects the two lateral walls and is engaged into the two connecting portions.

In one embodiment of the present invention, each of the two connecting portions is a through hole formed on an end face of each lateral wall opposite to the fixed jaw and extending toward the fixed jaw.

In another embodiment of the present invention, each of the two connecting portions is a slot formed on a lateral face of each lateral wall and extending toward the fixed jaw.

In any one embodiment of the present invention described above, the reinforcing device includes a body section and two leg sections extending from two opposite ends of the body section. The two leg sections are engaged into the two connecting portions of the head.

In any one embodiment of the present invention described above, the reinforcing device includes a connecting member, two connecting holes formed at the connecting member and corresponding to the two connecting portions of the head, and two fastener members inserting through the two connecting holes and engaging into the two connecting portions of the head.

The present invention resides not in any one of these features per se, but rather in the particular combination of all of them herein disclosed and claimed. It is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

An advantage of the adjustable wrench according to the present invention is that the adjustable wrench includes a reinforcing device for increasing its structural strength to prevent deformation of two lateral walls of a sliding rail of the adjustable wrench caused by improper operation or when impinged by an outside force.

Other advantages and features of the present invention will become apparent from the following description referring to the drawings.

BRIEF DESCRIPTION OF THE DRAWINGS

The illustrative embodiments may best be described by reference to the accompanying drawings where.

Figure 1:
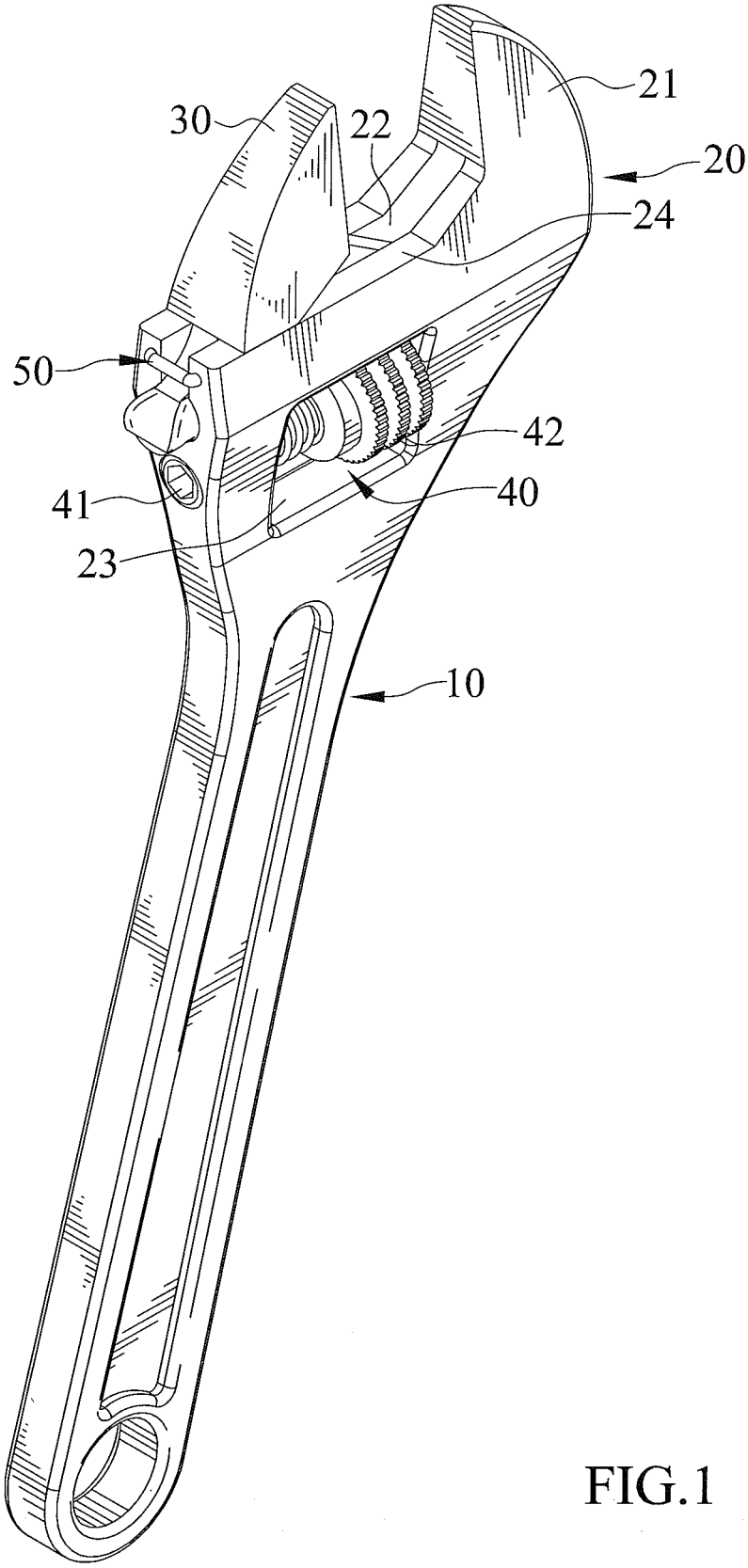
FIG. 1 shows a perspective view of an adjustable wrench with a reinforcing device in accordance with a first embodiment of the present invention.
Figure 2:
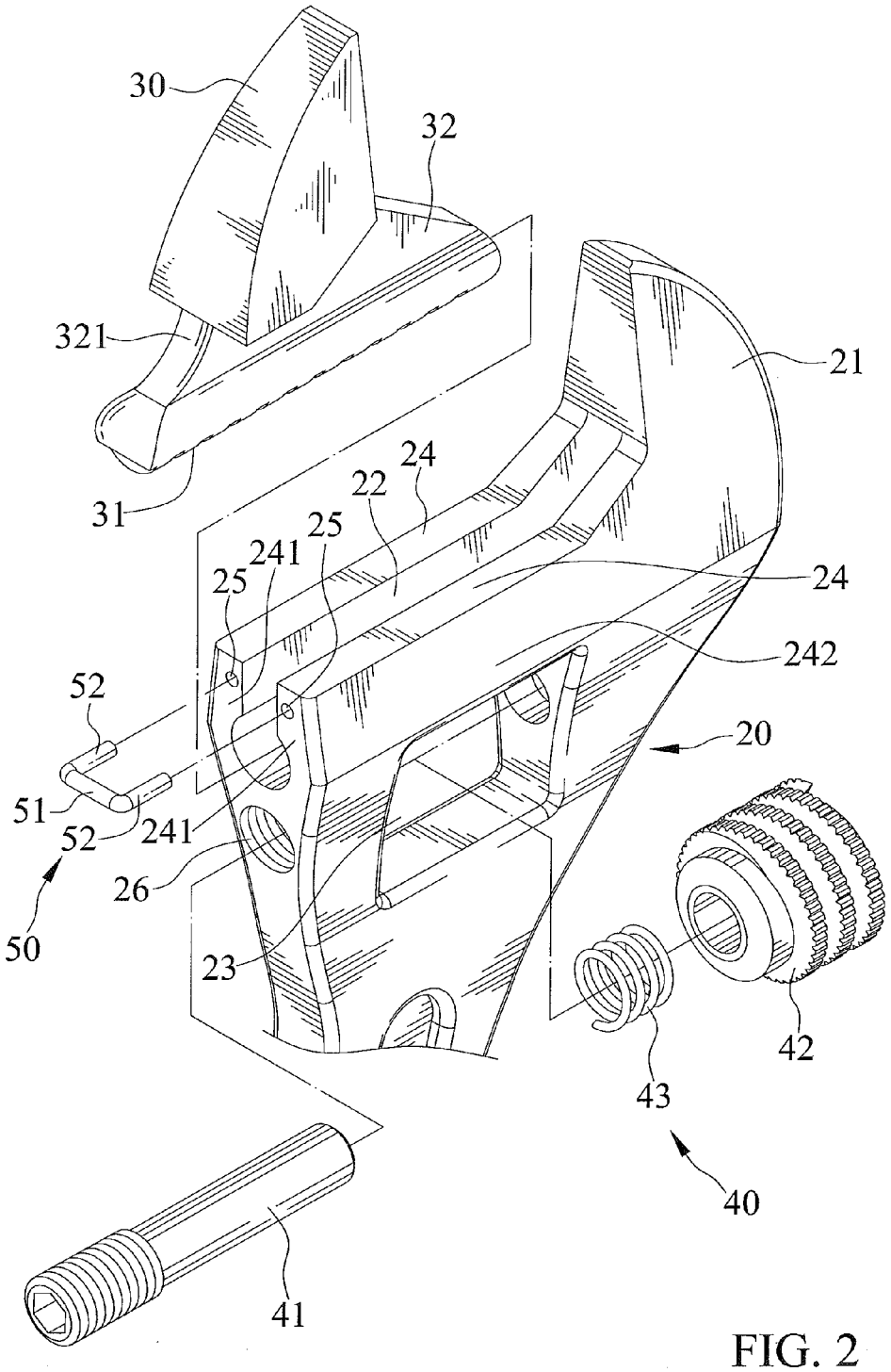
FIG. 2 shows a partial, exploded view of the adjustable wrench of FIG. 1.
Figure 3:
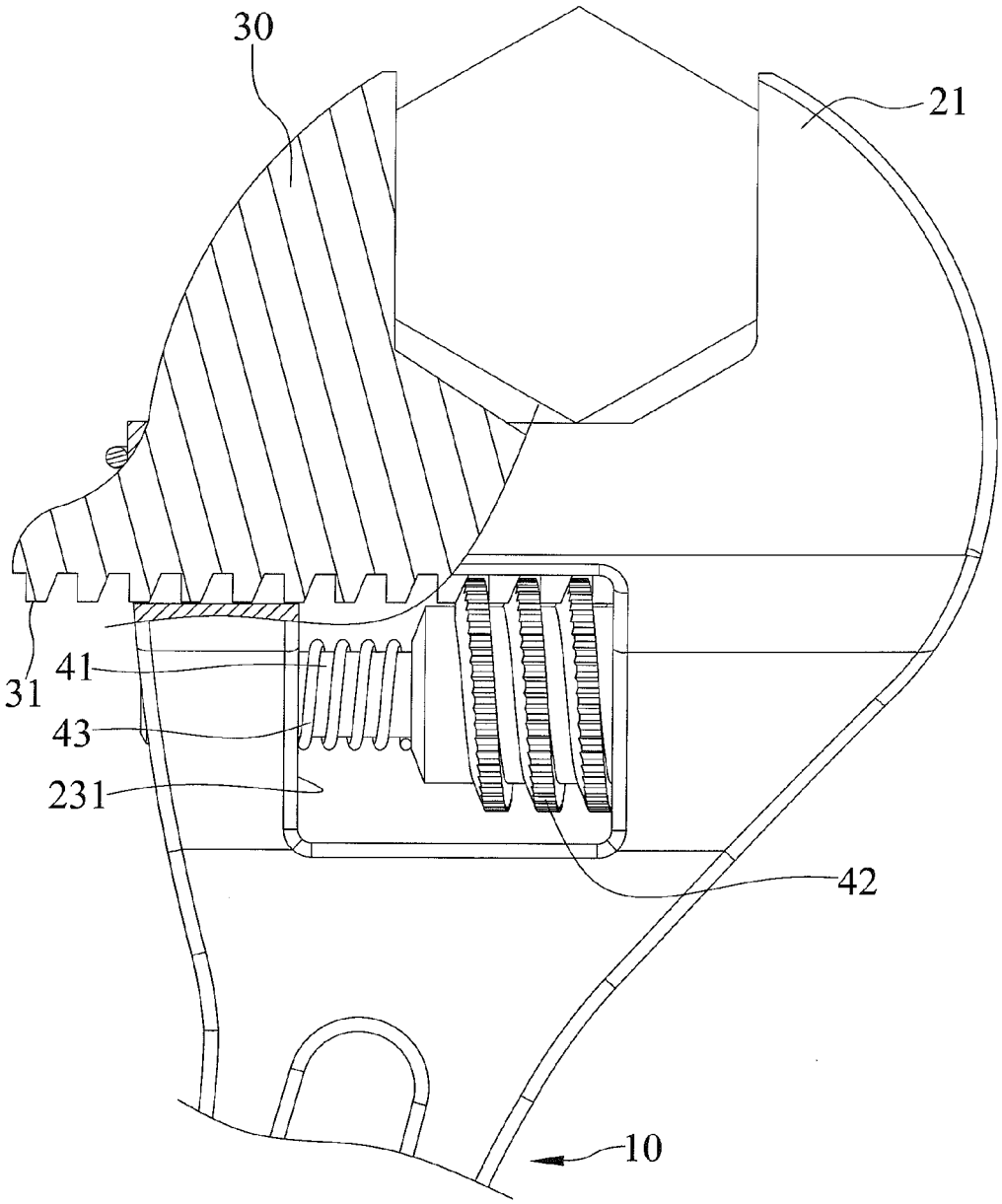
FIG. 3 shows a partial, cross-sectional view of the adjustable wrench of FIG. 1 and illustrates the adjustable wrench gripping an object.
Figure 4:
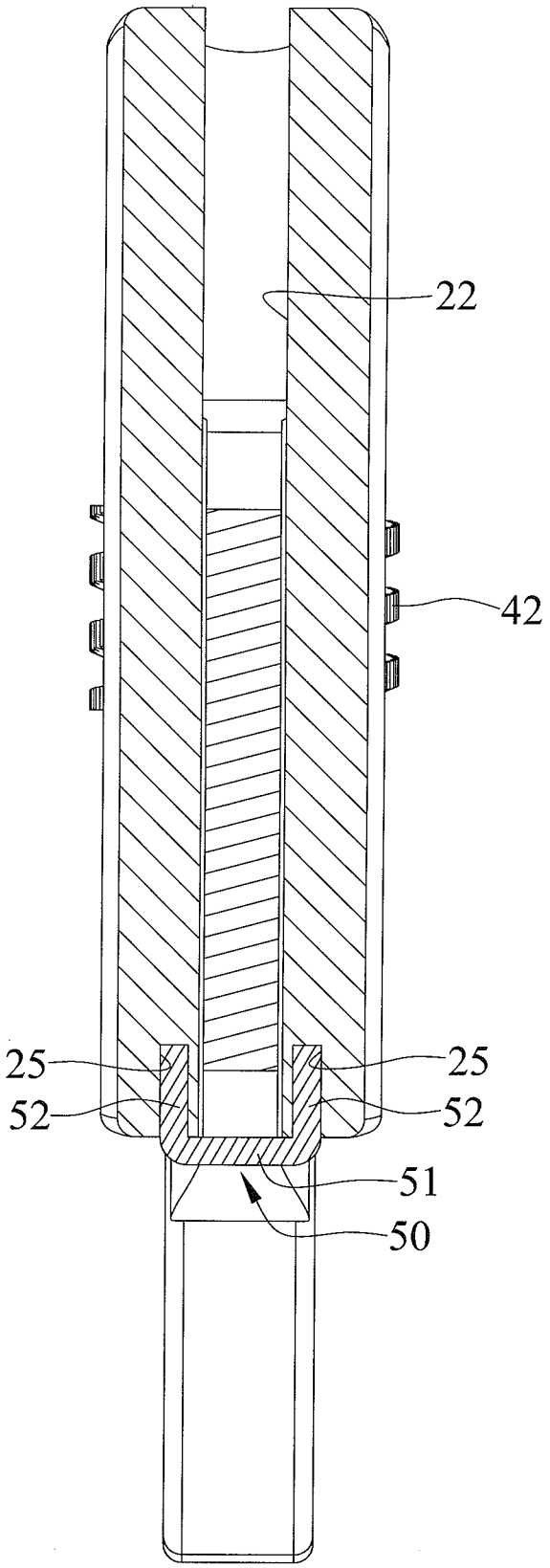
FIG. 4 shows a cross-sectional view of the adjustable wrench of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "longitudinal", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENTS

FIGS. 1 through 4 show an adjustable wrench in accordance with a first embodiment of the present invention. The adjustable wrench includes a handle 10, a head 20, a slidable jaw 30, an adjusting assembly 40, and a reinforcing device 50. The handle 10 is adapted to be gripped by a user. The head 20 is formed at one terminal end of the handle 10. Moreover, another end of the handle 10 may also be provided with another head 20. The head 20 includes a fixed jaw 21, a sliding rail 22, a receiving slot 23, two lateral walls 24, and two connecting portions 25. The fixed jaw 21 is formed at one end of the two lateral walls 24. The sliding rail 22 and the receiving slot 23 are connected and in communication with each other. The sliding rail 22 is formed between the two lateral walls 24. In the embodiment, each of the two connecting portions 25 is a through hole formed on an end face 241 of each lateral wall 24 opposite to the fixed jaw 21 and extending toward the fixed jaw 21. The slidable jaw 30 is slidably disposed in the sliding rail 22 of the head 20. The adjusting assembly 40 is positioned in the receiving slot 23 of the head 20 and includes an axial rod 41 and a worm gear 42. The axial rod 41 inserts through the worm gear 42, so that the worm gear 42 is moveable and rotatable in relation to the axial rod 41. The worm gear 42 is engaged with the slidable jaw 30 to control the movement of the slidable jaw 30. The reinforcing device 50 connects the two lateral walls 24 and is engaged into the two connecting portions 25.

In the embodiment, the reinforcing device 50 is a U-shaped one-piece structure. The reinforcing device 50 is formed with a body section 51 and two leg sections 52 extending from two opposite ends of the body section 51. An extending direction of each leg section 52 is substantially perpendicular to that of the body section 51. The two leg sections 52 are securely engaged into the two connecting portions 25 of the head 20, and the body section 51 is abutted against the end face 241 of each lateral wall 24.

Therefore, when an object is gripped in an opening formed between the fixed and slidable jaws 21 and 30 and turned, the body section 51 of the reinforcing device 50 connects the two lateral walls 24 to increase the structural strength to prevent deformation of two lateral walls 24 caused by the slidable jaw 30 pushing against the sliding rail 22.

Moreover, the slidable jaw 30 is provided with a sliding rod 31 and a contact portion 32 slidably disposed in the sliding rail 22 of the head 20. The sliding rod 31 is engaged with the worm gear 42, so that the user can rotate the worm gear 42 to control the movement of the slidable jaw 30 in relation to the fixed jaw 21 to adjust the width of the opening to be used with different sizes of the object. The contact portion 32 has a curved contact surface 321 disposed opposite to the fixed jaw 21 and contactable with the body section 51 of the reinforcing device 50 to provide the maximum width of the opening.

Additionally, the head 20 further includes a lateral through hole 26 connected and in communication with the receiving slot 23. One end of the axial rod 41 inserts through the worm gear 42, and another end of the axial rod 41 is threadly engaged into the through hole 26. The adjusting assembly 40 further includes an elastic member 43, which may be a coil spring mounted around the axial rod 41 and elastically abutting against an inner surface 231 of the receiving slot 23 and a lateral end face of the worm gear 42.

Figure 5:
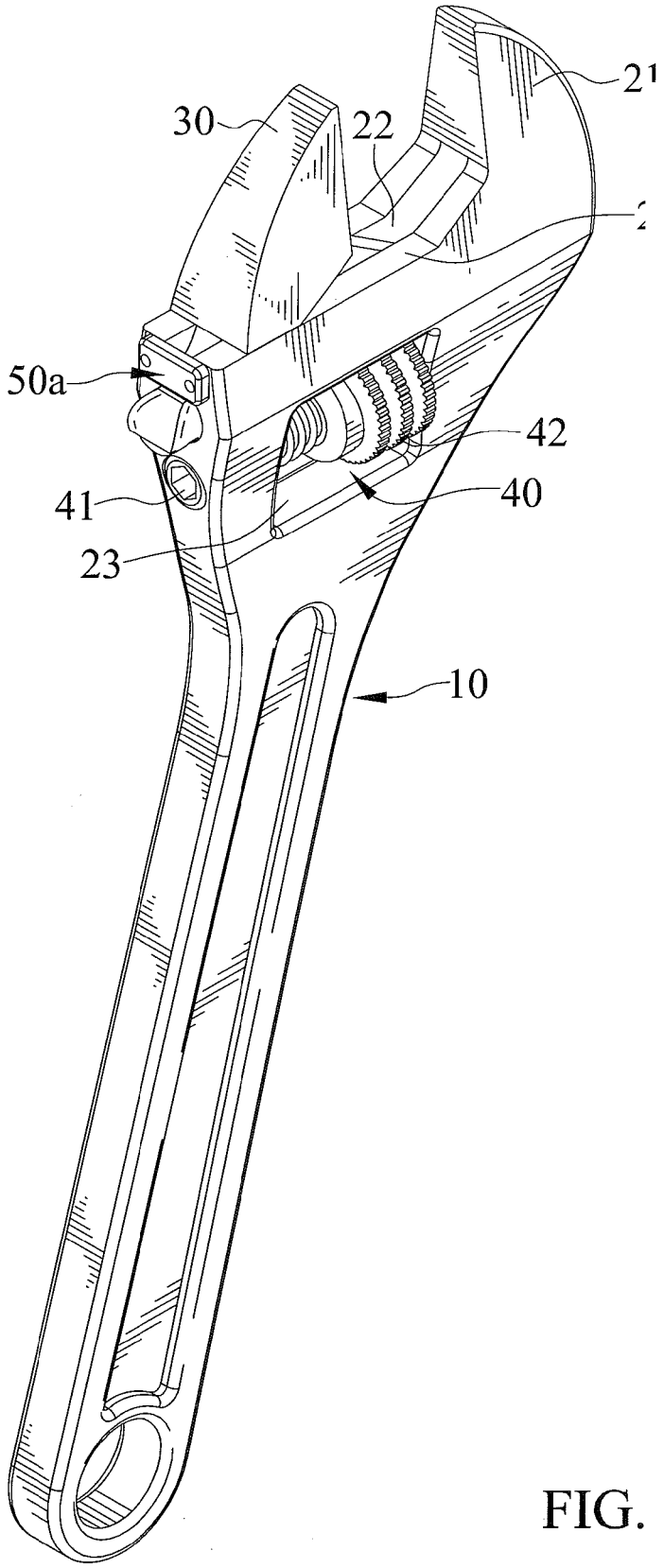
FIG. 5 shows a perspective view of an adjustable wrench with a reinforcing device in accordance with a second embodiment of the present invention.
Figure 6:
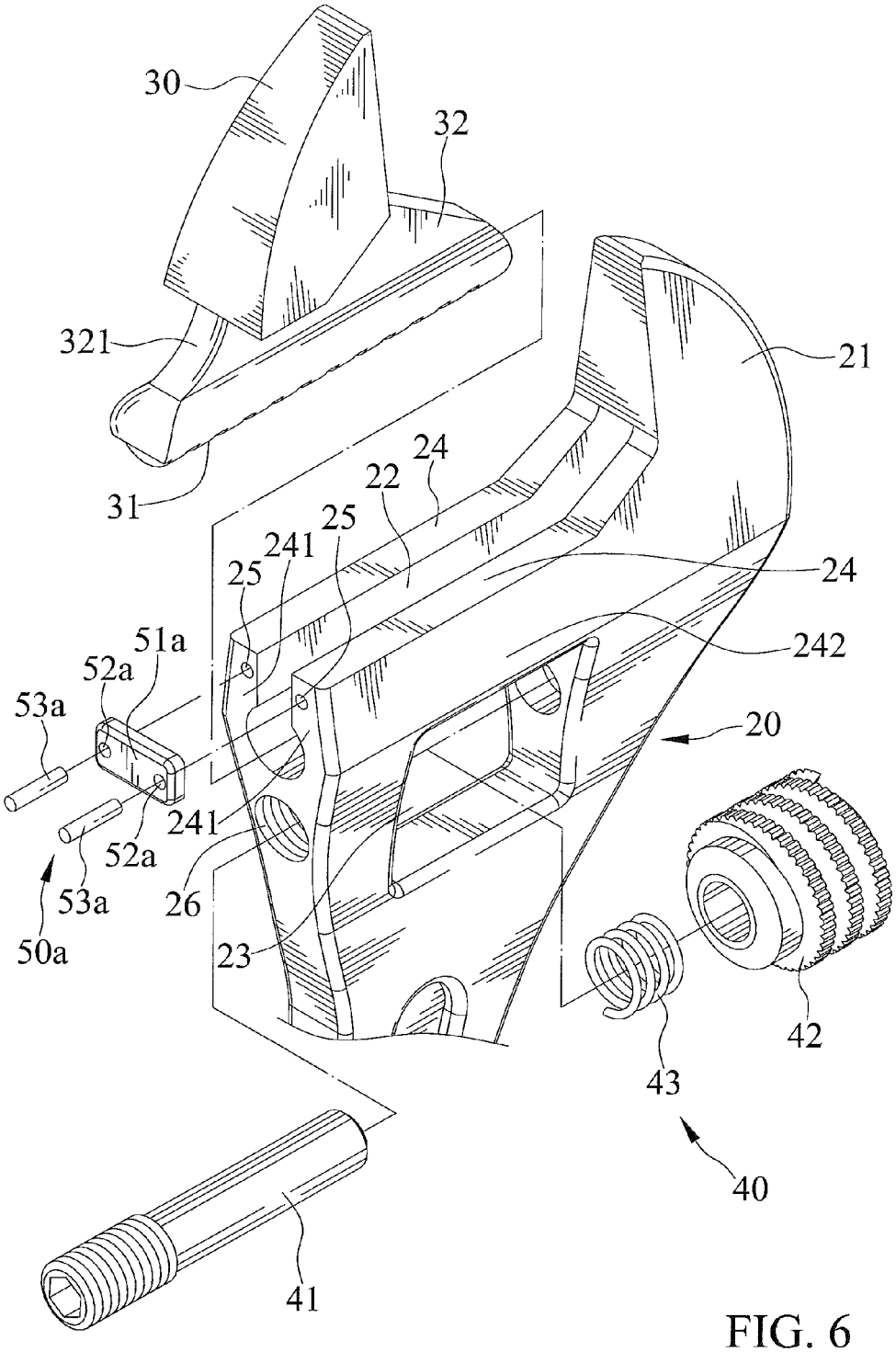
FIG. 6 shows a partial, exploded view of the adjustable wrench of FIG. 5.

FIGS. 5 and 6 show an adjustable wrench in accordance with a second embodiment of the present invention. The structure of the adjustable wrench of the second embodiment is substantially similar to that of the first embodiment except that the reinforcing device 50*a* includes a connecting member 51*a*, two connecting holes 52*a* formed at the connecting member 51*a* and corresponding to the two connecting portions 25 of the head 20, and two fastener members 53*a* inserting through the two connecting holes 52*a* and engaging into the two connecting portions 25 of the head 20. The connecting member 51*a* is abutted against the end face 241 of each lateral wall 24 and contactable with the curved contact surface 321.

Figure 7:
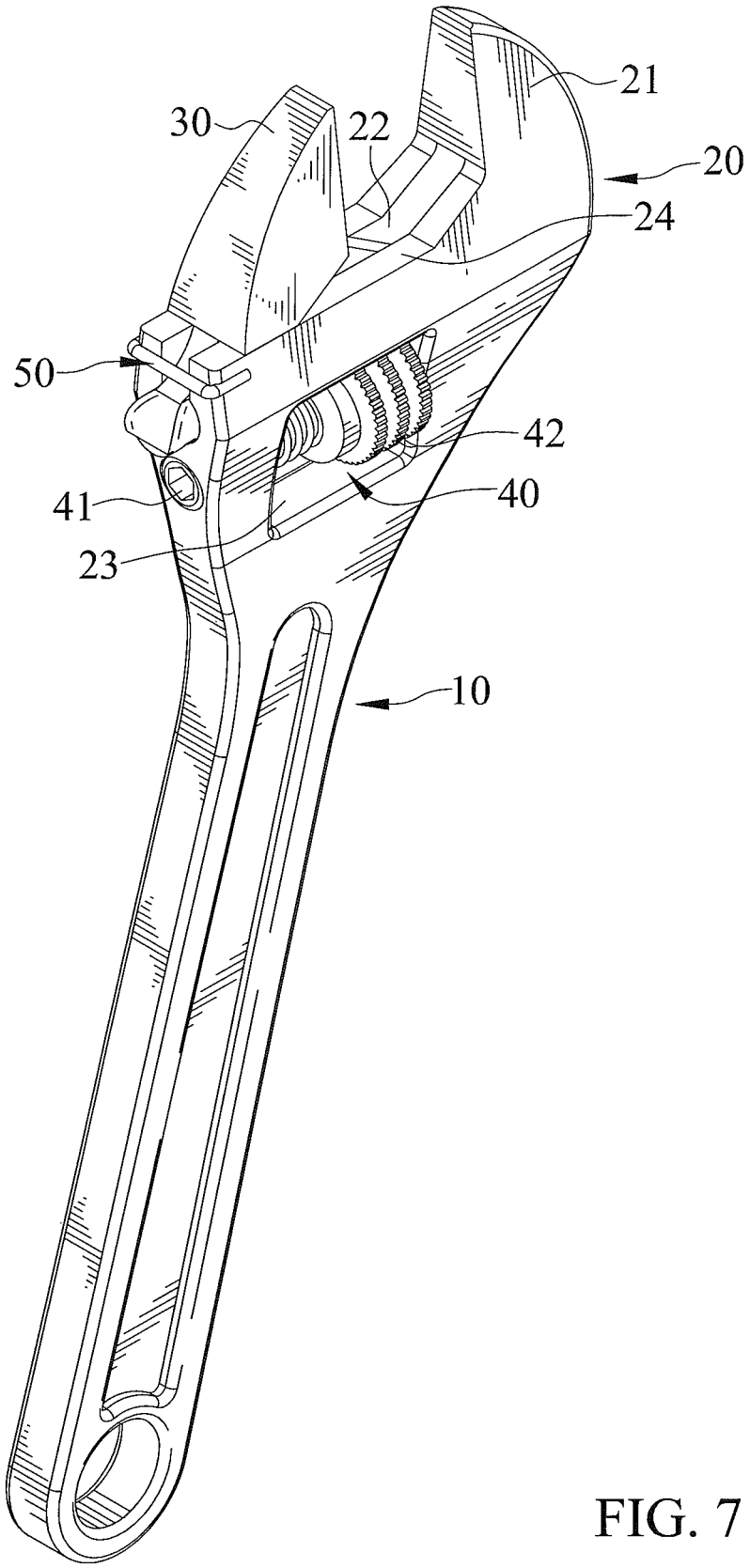
FIG. 7 shows a perspective view of an adjustable wrench with a reinforcing device in accordance with a third embodiment of the present invention.
Figure 8:
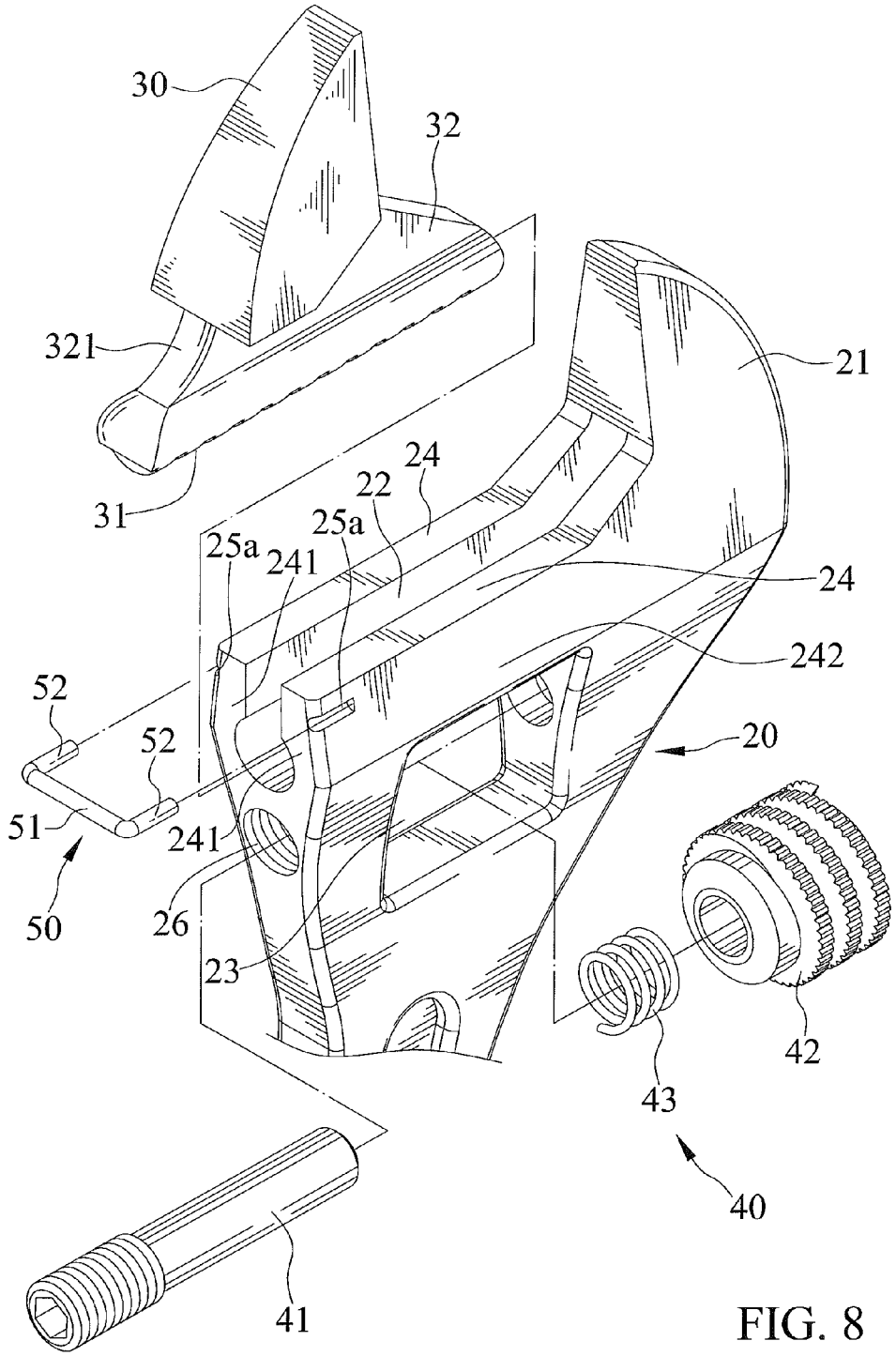
FIG. 8 shows a partial, exploded view of the adjustable wrench of FIG. 7.

FIGS. 7 and 8 show an adjustable wrench in accordance with a third embodiment of the present invention. The structure of the adjustable wrench of the second embodiment is substantially similar to that of the first embodiment except that each of the two connecting portions 25*a* is a slot formed on a lateral face 242 of each lateral wall 24 and extending toward the fixed jaw 21. An extending direction of the lateral face 242 of each lateral wall 24 is substantially perpendicular to that of the end face 241 of each lateral wall 24. The two leg sections 52 are securely engaged into the two connecting portions 25*a* of the head 20.

In view of the forgoing, it is an object of the present invention to provide an adjustable wrench that includes a reinforcing device for increasing its structural strength to prevent deformation of two lateral walls of a sliding rail of the adjustable wrench caused by improper operation or when impinged by an outside force.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An adjustable wrench comprising:

a handle;

a head formed at one end of the handle and including a fixed jaw, a sliding rail, a receiving slot, two lateral walls, and two connecting portions, with the fixed jaw formed at one end of the two lateral walls, with the sliding rail formed between the two lateral walls, with the receiving slot connected and in communication with the sliding rail, with each connecting portion formed at one end of each lateral wall opposite to the fixed jaw, wherein each of the two connecting portions is a through hole formed on an end face of each lateral wall opposite to the fixed jaw and extending toward the fixed jaws;

a slidable jaw slidably disposed in the sliding rail of the head;

an adjusting assembly positioned in the receiving slot of the head and including an axial rod and a worm gear, with the axial rod inserting through the worm gear, with the worm gear engaged with the slidable jaw; and a reinforcing device connecting the two lateral walls and engaged into the two connecting portions.

2. The adjustable wrench as claimed in claim 1, wherein the reinforcing device includes a body section and two leg sections extending from two opposite ends of the body section, with the two leg sections engaged into the two connecting portions of the head.

3. The adjustable wrench as claimed in claim 2, wherein the slidable jaw is provided with a sliding rod and a contact portion slidably disposed in the sliding rail of the head, with the sliding rod engaged with the worm gear, with the contact portion having a curved contact surface disposed opposite to the fixed jaw and contactable with the body section of the reinforcing device.

4. The adjustable wrench as claimed in claim 1, wherein the reinforcing device includes a connecting member, two connecting holes formed at the connecting member and corresponding to the two connecting portions of the head, and two fastener members inserting through the two connecting holes and engaging into the two connecting portions of the head.

5. The adjustable wrench as claimed in claim 4, wherein the slidable jaw is provided with a sliding rod and a contact portion slidably disposed in the sliding rail of the head, with the sliding rod engaged with the worm gear, with the contact portion having a curved contact surface disposed opposite to the fixed jaw and contactable with the connecting member of the reinforcing device.

6. An adjustable wrench comprising:

a handle;

a head formed at one end of the handle and including a fixed jaw, a sliding rail, a receiving slot, two lateral walls, and two connecting portions, with the fixed jaw formed at one end of the two lateral walls, with the sliding rail formed between the two lateral walls, with the receiving slot connected and in communication with the sliding rail, with each connecting portion formed at one end of each lateral wall opposite to the fixed jaw, wherein each of the two connecting portions is a slot formed on a lateral face of each lateral wall and extending toward the fixed jaw;

a slidable jaw slidably disposed in the sliding rail of the head;

an adjusting assembly positioned in the receiving slot of the head and including an axial rod and a worm gear, with the axial rod inserting through the worm gear, with the worm gear engaged with the slidable jaw; and a reinforcing device connecting the two lateral walls and engaged into the two connecting portions.

7. The adjustable wrench as claimed in claim 6, wherein the reinforcing device includes a body section and two leg sections extending from two opposite ends of the body section, with the two leg sections engaged into the two connecting portions of the head.

8. The adjustable wrench as claimed in claim 7, wherein the slidable jaw is provided with a sliding rod and a contact portion slidably disposed in the sliding rail of the head, with the sliding rod engaged with the worm gear, with the contact portion having a curved contact surface disposed opposite to the fixed jaw and contactable with the body section of the reinforcing device.

9. The adjustable wrench as claimed in claim 6, wherein the reinforcing device includes a connecting member, two connecting holes formed at the connecting member and corresponding to the two connecting portions of the head, and two fastener members inserting through the two connecting holes and engaging into the two connecting portions of the head.

10. The adjustable wrench as claimed in claim 9, wherein the slidable jaw is provided with a sliding rod and a contact portion slidably disposed in the sliding rail of the head, with the sliding rod engaged with the worm gear, with the contact portion having a curved contact surface disposed opposite to the fixed jaw and contactable with the connecting member of the reinforcing device.

* * * * *